US007820930B2

(12) United States Patent
Mao

(10) Patent No.: US 7,820,930 B2
(45) Date of Patent: Oct. 26, 2010

(54) LOW-PROFILE SWITCH MECHANISM

(75) Inventor: Da-Yong Mao, Zhongshan (CN)

(73) Assignees: Camry Industries (H.K.) Limted, Kowloon (HK); Zhongshan Camry Electronic Company Limited, Guangdong (CN)

( * ) Notice: Subject to any disclaimer, the term of this patent is extended or adjusted under 35 U.S.C. 154(b) by 253 days.

(21) Appl. No.: 12/082,378

(22) Filed: Apr. 9, 2008

(65) Prior Publication Data

US 2009/0194402 A1 Aug. 6, 2009

(30) Foreign Application Priority Data

Feb. 5, 2008 (HK) ..... 08101343.4

(51) Int. Cl.
*H01H 13/70* (2006.01)

(52) U.S. Cl. ..... 200/343; 200/341

(58) Field of Classification Search ..... 200/343
See application file for complete search history.

(56) References Cited

U.S. PATENT DOCUMENTS 4,295,017 A * 10/1981 Kashima et al. ..... 200/47
6,740,830 B2 * 5/2004 Sato et al. ..... 200/343
7,005,588 B2 * 2/2006 Pihlaja ..... 200/5 A

* cited by examiner

*Primary Examiner*—Renee Luebke
*Assistant Examiner*—Lisa Klaus
(74) *Attorney, Agent, or Firm*—Alix, Yale & Ristas, LLP

(57) ABSTRACT

A switch mechanism includes a frame, an electrical switch on the frame, a lever extending from the frame alongside the switch and including an activation portion whereupon deflection of the lever, the activation portion bears upon the switch so as to activate the switch A force-transfer device associated with the frame moves upon user-activation to deflect the lever. Furthermore, the present switch mechanism is not limited in its application to ON-OFF switches as it could be equally applied to other function switches of low-profile devices.

10 Claims, 2 Drawing Sheets

LOW-PROFILE SWITCH MECHANISM

BACKGROUND OF THE INVENTION

The present invention relates to switches. More particularly, although not exclusively, the invention relates to a switch mechanism for use in low-profile slim-line devices such as body weight scales in which the overall height of the device is to be minimised.

Digital body weight scales for example have an ON switch which upon activation delivers electrical power to internal circuitry. An internal microswitch is mechanically activated when a user steps onto the scales and presses a button. Such switch mechanisms are relatively tall and therefore limit the extent to which such body weight scales can be designed with a modern low-profile or slim-line appearance.

OBJECTS OF THE INVENTION

It is an object of the present invention to overcome or substantially ameliorate the above disadvantage and/or more generally to provide an improved switch mechanism adapted for use in low-profile devices.

DISCLOSURE OF THE INVENTION

There is disclosed herein a switch mechanism comprising:

a frame;

an electrical switch on the frame;

a lever extending from the frame alongside the switch and including an activation portion whereupon deflection of the lever, the activation portion bears upon the switch so as to activate the switch; and a force-transfer device associated with the frame and movable upon user-activation to deflect the lever.

Preferably, the lever extends toward the switch and includes a dogleg before the activation portion which extends partly about the switch.

Preferably, the lever is formed integrally with the frame.

Preferably, the force transfer device comprises a spring plate attached to the frame.

Preferably, the spring plate is substantially planar when not deformed and is attached at its periphery to the frame and includes a central portion which can deflect out of the plane of the spring plate.

Preferably, the force transfer device further comprises a sensor which bears down upon the central portion of the spring plate upon user-activation.

Preferably, the force transfer device further comprises a sensor stand attached to the central portion of the spring plate, a support foot attached to the sensor stand and a non-slip pad upon the support foot.

Preferably, the switch mechanism further comprises a compression spring bearing against the central portion of the spring plate than providing a return force thereto.

BRIEF DESCRIPTION OF THE DRAWINGS

A preferred form of the present invention will now be described by way of example with reference to the accompanying drawings, wherein.

DESCRIPTION OF THE PREFERRED EMBODIMENTS

Figure 1:
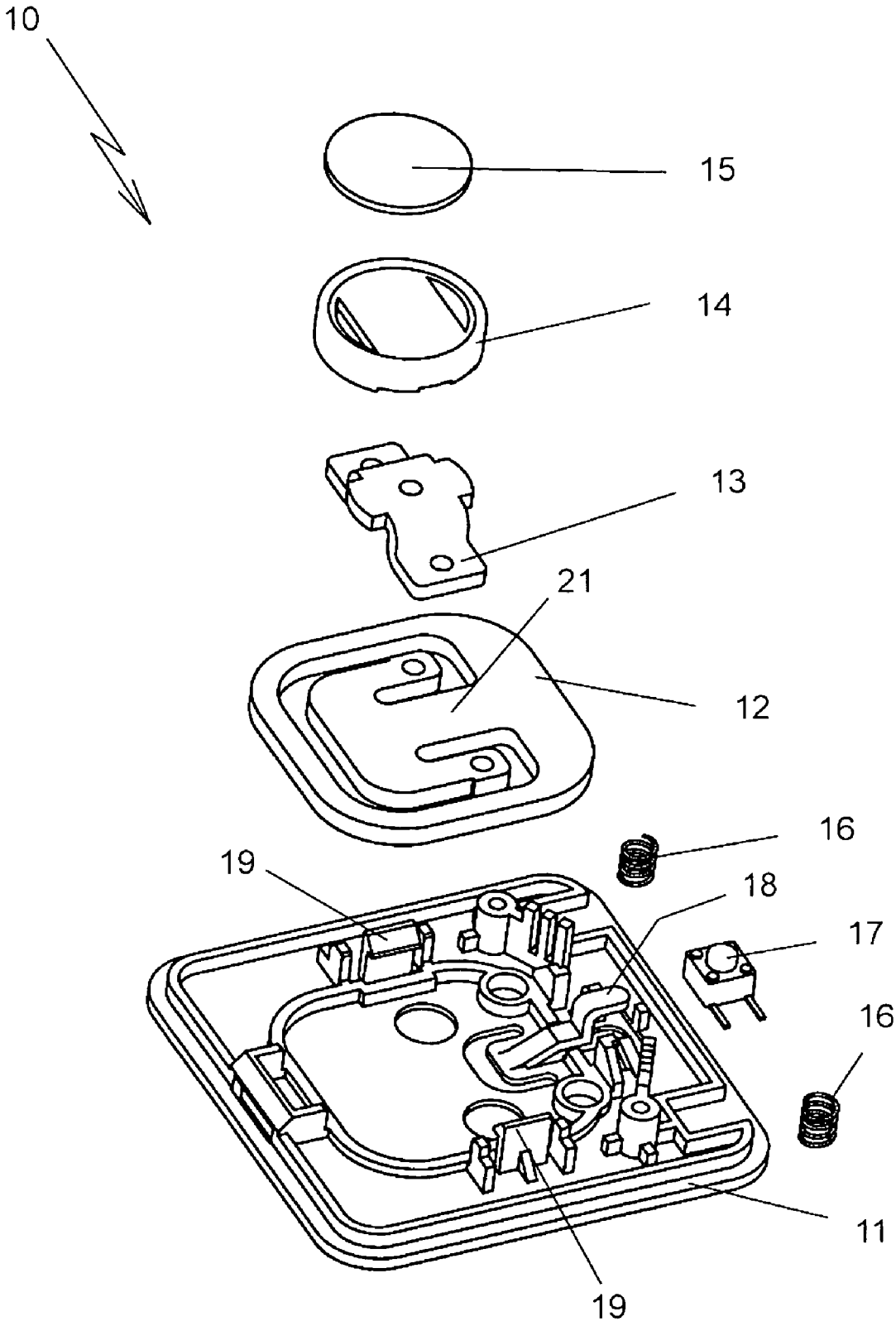
FIG. 1 is a schematic parts-exploded perspective illustration of a switch mechanism.
Figure 2:
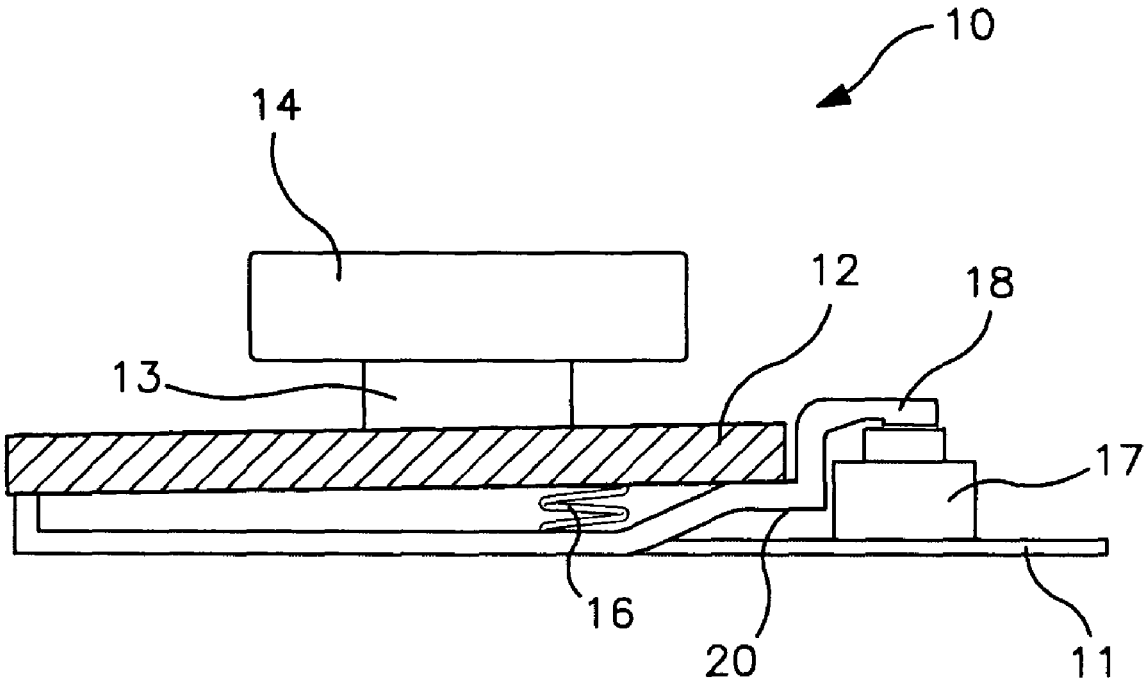
FIG. 2 is a schematic cross-sectional elevation of the switch mechanism in a non-activated state.
Figure 3:
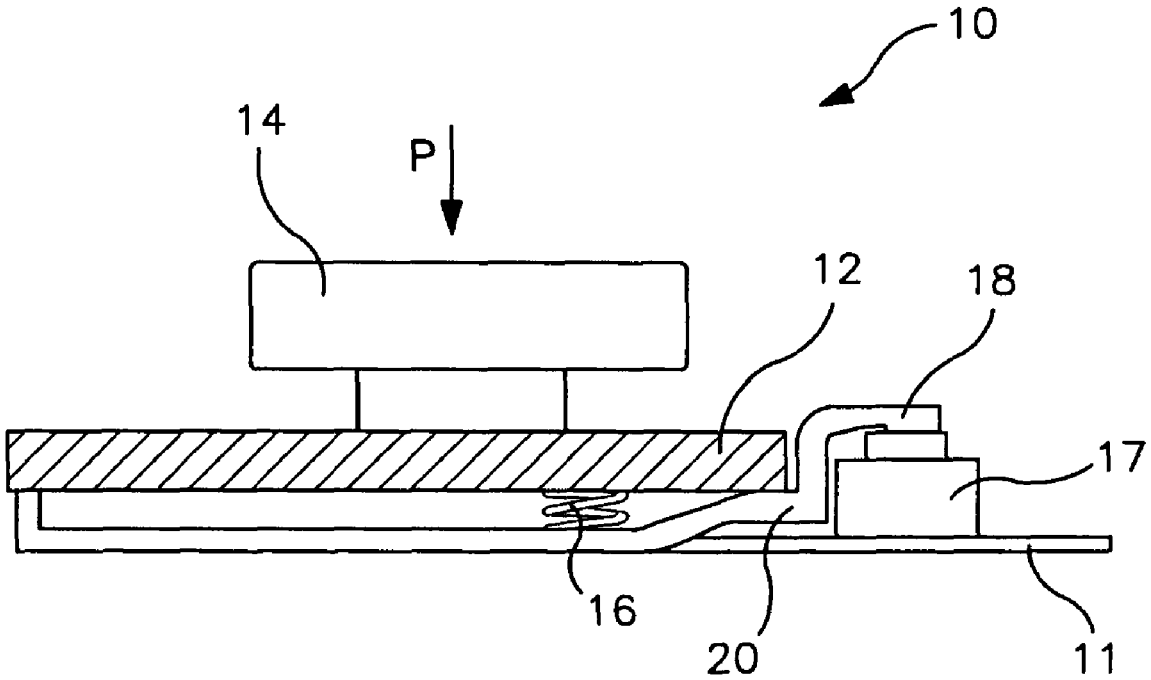
FIG. 3 is a schematic cross-sectional elevation of the switch mechanism of FIG. 2 in a depressed/activated state.

In the accompanying drawings there is depicted schematically a switch mechanism 10. The mechanism comprises a frame 11 typically of moulded resilient plastics material which would be secured internally to the chassis of an appliance such as a set of low-profile body weight scales. To this end, several mounting holes are provided as shown.

The frame 11 includes a pair of opposed snap-engaging tabs 19 for receiving opposed peripheral edges of a spring plate 12. The spring plate might be formed of resilient plastics or metallic material.

The frame 11 receives a microswitch 17 and includes an integral resilient lever 18 having a dogleg 20 extending to a switch-activation portion at its distal end. The switch-activation portion bears down upon the pushbutton of the microswitch 17.

When snap-engaged by tabs 19 of the frame 11, a leading peripheral edge of the spring plate 12 rests upon the dogleg portion 20 of the lever 18. The resilience of the lever 18 provides a resistive force against the downward movement of the spring plate 12 in use.

The spring plate 12 is basically planar and includes a central portion which is connected by a resilient bridge 21. The central portion can thereby deflect out of the plane of the spring plate 12. A pair of coil springs 16 upon the frame 11 bear upwardly against the central portion of the spring plate to assist in providing a return force thereto.

A sensor stand 13 is secured to the central portion of the spring plate and receives a support foot 14 which forms part of a user-activated pushbutton including a non-slip pad 15.

In use, a downward force P is applied to the non-slip pad 15 and this is relayed via the sensor stand 13 to the central portion of the spring plate 12. The spring plate thereby bears down upon springs 16 and the resilient lever 18 so as to activate the microswitch 17. The microswitch 17 would typically be a momentary contact type for providing initial switching to power-up internal circuitry of the scales. Turning OFF would typically be provided by timer circuitry. As an alternative, the microswitch might be a push-on/push-off type.

As can be seen, the provision of a lever 18 with a dogleg portion 20 minimises the overall height of the switch mechanism making it suitable for use in low-profile devices.

It should be appreciated that modifications and alterations obvious to those skilled in the art are not to be considered as beyond the scope of the present invention. For example, rather than providing a dogleg and a vertically oriented microswitch, a horizontally oriented microswitch might be provided and the end of the lever 18 might be provided with an angled "cam" surface for bearing against the microswitch button.

The invention claimed is:

1. A switch mechanism comprising:

a frame;

an electrical switch on the frame;

a lever extending from the frame alongside the switch and including an activation portion where, upon deflection of the lever, the activation portion bears upon the switch so as to activate the switch; and a force-transfer device movable upon user-activation to deflect the lever, said force transfer device comprising a spring plate which is substantially planar when not deformed and is attached at its periphery to the frame and includes a central portion which can deflect out of the plane of the spring plate, and a sensor which bears down upon the central portion of the spring plate upon user-activation.

2. The switch mechanism of claim 1, wherein the lever extends toward the switch and includes a dogleg before the activation portion which extends partly above the switch.

3. The switch mechanism of claim 1, wherein the lever is formed integrally with the frame.

4. The switch mechanism of claim 1, wherein the force transfer device further comprises a sensor stand attached to the central portion of the spring plate, a support foot attached to the sensor stand and a non-slip pad upon the support foot.

5. The switch mechanism of claim 1, further comprising a compression spring bearing against the central portion of the spring plate that provides a return force thereto.

6. A switch mechanism comprising:

a frame;

an electrical switch on the frame;

a lever extending from the frame alongside the switch and including an activation portion where, upon deflection of the lever, the activation portion bears upon the switch so as to activate the switch; and a force-transfer device movable upon user-activation to deflect the lever, said force transfer device comprising a spring plate which is substantially planar when not deformed and is attached at its periphery to the frame and includes a central portion which can deflect out of the plane of the spring plate, and a compression spring bearing against the central portion of the spring plate that provides a return force thereto.

7. The switch mechanism of claim 6, wherein the force transfer device further comprises a sensor which bears down upon the central portion of the spring plate upon user-activation.

8. The switch mechanism of claim 6, wherein the lever extends toward the switch and includes a dogleg before the activation portion which extends partly above the switch.

9. The switch mechanism of claim 6, wherein the lever is formed integrally with the frame.

10. The switch mechanism of claim 6, wherein the force transfer device further comprises a sensor stand attached to the central portion of the spring plate, a support foot attached to the sensor stand and a non-slip pad upon the support foot.

* * * * *